United States Patent [19]

Betz et al.

[11] Patent Number: 4,509,495

[45] Date of Patent: Apr. 9, 1985

[54] IGNITION COIL FOR A MULTI-CYLINDER INTERNAL COMBUSTION ENGINE

[75] Inventors: Dieter Betz, Vaihingen; Jörg Issler, Stuttgart, both of Fed. Rep. of Germany

[73] Assignee: Robert Bosch GmbH, Stuttgart, Fed. Rep. of Germany

[21] Appl. No.: 577,264

[22] Filed: Feb. 6, 1984

[30] Foreign Application Priority Data

Apr. 21, 1983 [DE] Fed. Rep. of Germany ..... 3314410

[51] Int. Cl.[3] ..... F02P 1/00

[52] U.S. Cl. ..... 123/643; 123/621; 123/622; 123/634

[58] Field of Search ..... 123/621, 622, 634, 643

[56] References Cited

U.S. PATENT DOCUMENTS

| | | | |
|---|---|---|---|
| 1,428,635 | 9/1922 | Hunt | 123/622 |
| 2,093,700 | 9/1937 | Wallenta | 123/634 |
| 2,100,210 | 11/1937 | Cain | 123/621 |
| 3,926,557 | 12/1975 | Callies | 123/621 |
| 3,980,922 | 9/1976 | Katsumata | 123/621 |
| 4,167,928 | 9/1979 | Ragel | 123/643 |
| 4,203,404 | 5/1980 | Canup | 123/643 |
| 4,233,949 | 11/1980 | d'Orsay | 123/634 |
| 4,381,757 | 5/1983 | Morino | 123/622 |
| 4,446,842 | 5/1984 | Iwasaki | 123/634 |

FOREIGN PATENT DOCUMENTS

| | | | |
|---|---|---|---|
| 2846425 | 5/1979 | Fed. Rep. of Germany | 123/634 |

*Primary Examiner*—Ronald B. Cox

*Attorney, Agent, or Firm*—Frishauf, Holtz, Goodman & Woodward

[57] ABSTRACT

To provide ignition energy to respective spark plugs of a multi-cylinder internal combustion engine (ICE) without a distributor, winding groups, each including a primary and secondary winding, are located on respective core portions of an iron core, which core portions are coupled together by zones (a, b, c) of high magnetic reluctance, or low magnetic flux conductivity; the winding groups can be located on L cores (16, 17) with two high-reluctance gaps between the ends of the facing L cores (FIG. 1) or on a common U core (28, 30, 29) with a cross yoke (31) spaced from the ends of the legs of the U. Interruption of current flow through the primary of any one of the winding groups will then not induce in the secondary of the other winding group a voltage high enough to cause spark-over at the other secondary; free-wheeling diodes (14, 22), connected across the primaries, can suppress current flow in the primary not being interrupted; and diodes (12, 13; 25, 26), serially connected with spark plugs, likewise suppress spurious spark-over.

10 Claims, 6 Drawing Figures

28
29
30
31
32
33
34
35
C

IGNITION COIL FOR A MULTI-CYLINDER INTERNAL COMBUSTION ENGINE

The present invention relates to an ignition coil for a multi-cylinder internal combustion engine (ICE) in which spark energy to the respective cylinders of the ICE is derived directly from the ignition coil, without an intervening distributor.

BACKGROUND

Ignition coils for multi-cylinder ICEs, in which ignition energy for respective spark plugs is steered to a plurality of primary windings of the ignition coil, rather than being distributed, later, by a high-voltage distributor, have already been proposed—see, for example, German Patent Disclosure Document DE-OS 28 46 425, Poirier. The ignition coil of the there disclosed publication uses a plurality of primary windings and secondary windings, in which the respective windings are separated from each other and located on different portions of an iron core. The structure becomes complex and requires a relatively large amount of material, so that the overall size of the ignition coil becomes large, and the coil is heavy. The secondary windings must be shielded from each other with respect to the primary windings of different winding groups, associated with different spark plugs of different cylinders, by expensive shielding arrangements.

THE INVENTION

It is an object to construct a multiple ignition coil for a multi-cylinder internal combustion (ICE) which is simple, inexpensive to construct, and substantially lighter and more compact than structures of the prior art.

Briefly, the coil is so arranged that the primary and secondary windings associated with any one spark plug or set of spark plugs are wound on an individual common core portion of the core, the core portions associated with any one winding group being coupled by an interrupted portion of high magnetic reluctance, for example a small gap or the like, and the coils and cores, additionally, are so arranged that the distance between the primary and secondary winding, forming a winding group, is small with respect to the distance between winding groups. The gap may be an air gap.

The coil which is so constructed has the advantage that it can be made in dimensions which are substantially smaller than heretofore thought possible, provides excellent separation between winding loops, is compact, and readily manufactured, and permits variations in structural arrangement of the winding groups to accomodate various core designs.

Figures 3A, 3B, 4A, 4B:
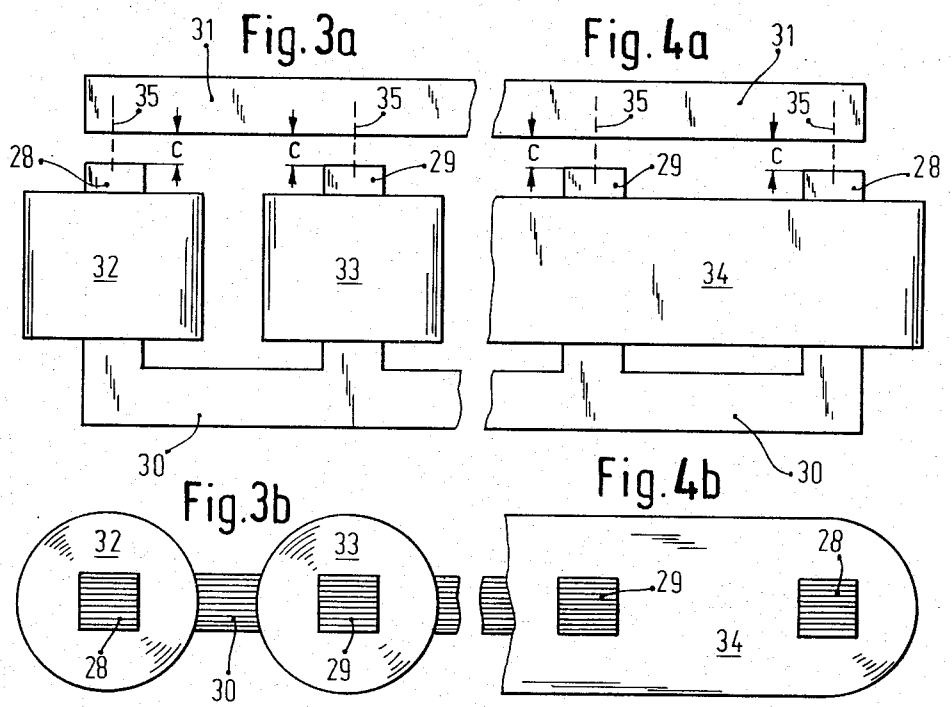

FIGS. 3*a* and 3*b* are side views and top views, respectively, of another embodiment; and FIGS. 4*a* and 4*b* are side views and top views of yet another embodiment, wherein in both FIGS. 3*b* and 4*b* the top yoke has been omitted for clarity of representation.

DETAILED DESCRIPTION

The ignition system is intended to be used with an internal combustion engine (ICE) which is not shown. Only the crankshaft of the engine, CS, is schematically shown, rotating in the direction of the arrow n. The crankshaft is coupled to a pick-up system which includes a disk having a marker R thereon, which provides operating pulses at outputs 8*b*, 27*b* to control respective switches 8, 27 via terminals 8*a*, 27*a*, as will appear. All intermediate circuitry to provide for appropriate timing has been omitted for clarity, and may be in accordance with any standard and well known electronic ignition system. Alternatively, the pick-up disk R and the pick-ups providing outputs at terminals 8*b*, 27*b* may be mechanical breaker-type switches integrated with the switches 8, 27, respectively.

Figure 1:
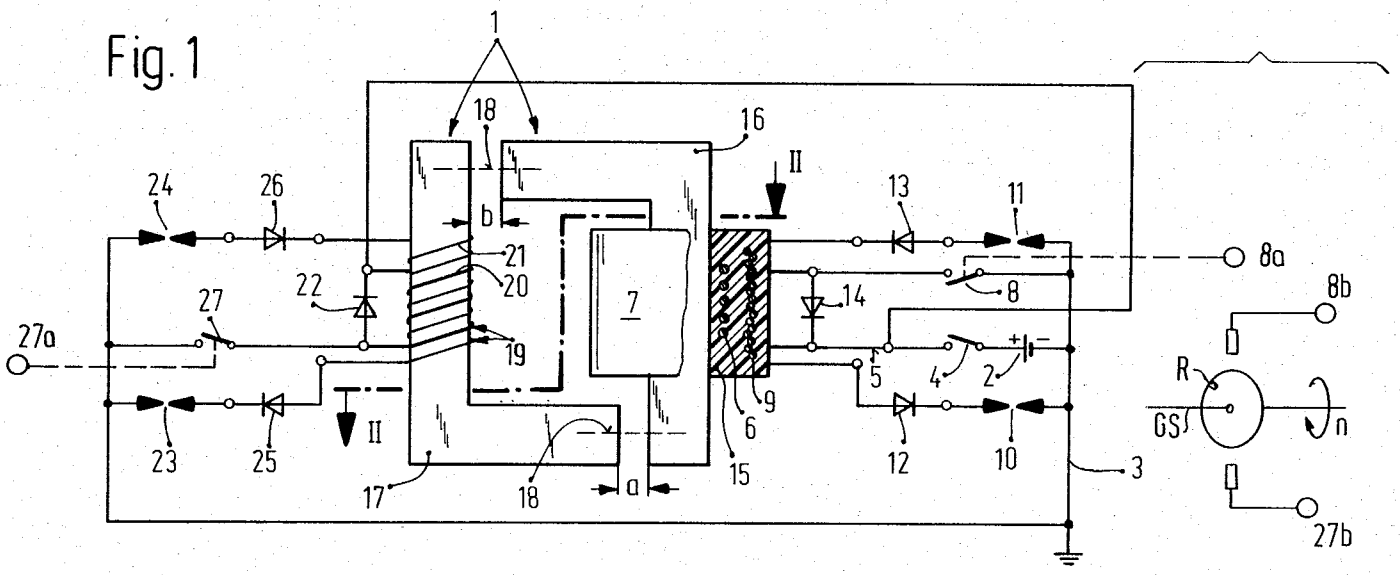
FIG. 1 is a part-schematic, part-pictorial diagram of the ignition coil in an ignition system in which all elements not necessary for an understanding of the present invention have been omitted.

The ignition coil 1 is supplied with electrical energy from an energy source 2 which, for example, may be a battery of an automotive vehicle. The battery 2 has its negative terminal connected to ground or chassis by a ground bus 3. The positive terminal of battery 2 is connected through an ignition switch 4 to a positive supply bus or positive supply terminal 5. The supply bus or terminal 5 is connected to the primary winding 6 of a first winding group 7, and is then connected through the primary winding to a breaker switch 8, the other terminal of which is grounded, as shown in FIG. 1. The first winding group 7 has, besides primary winding 6, a secondary winding 9 which has its end terminals connected to respective spark gaps of spark plugs 10, 11, the other terminals of the spark gaps of which are grounded, as is customary in automotive-type spark plugs. The respective spark plugs 10, 11 are connected to the terminals of the secondary through two diodes 12, 13. A free-wheeling or shunt diode 14 can be connected across the primary winding 6, polarized in blocking direction with respect to the battery 2.

In accordance with a feature of the invention, the primary winding 6 and the secondary winding 9 of the first winding group 7 are coaxial on a core portion 16 of an iron core which, preferably, is laminated. The windings 6, 9 are so arranged that the secondary 9 overlaps the primary-see FIG. 1. The primary winding is on the inside, adjacent the core 16. The primary and secondary windings are potted in a potting compound or resin 15 and, together with the core portion 16, form a single unit. The core portion 16 is L-shaped when looked at in plan view, and the first winding group 7 is located on one of the longer legs of the L.

The core portion 16 is part of a magnetic circuit. Referring to FIG. 1, and tracing the magnetic circuit in clockwise direction, the core portion 16 is spaced by a gap a of magnetically poor flux conductivity from a second core portion 17. Second core portion 17 is coupled by a gap b, which may be similar to gap a, of magnetically poor conductivity, that is, of high reluctance, with the transverse leg of the L-shaped core portion 16. The core portions 16, 17 may be identical, positioned as shown in FIG. 1. The gaps of high reluctance a, b, in a preferred form, are air gaps; they may, however, be gaps which have a reluctance which is similar to that of air. Connecting elements for the two core portions 16, 17 are shown only schematically by the broken lines 18 and may, for example, be clamps surrounding the cores, with an intervening high-reluctance spacer, air gap, or other suitable arrangements, for example through-bolts of non-magnetic material. The core portions 16, 17 are securely connected together.

The core portions 17 carries a second winding groove 19 which has a primary winding and secondary winding 21. The primary winding 20 and the secondary winding 21 of the winding group 20 are shown only symbolically in FIG. 1; their construction may be similar to and, preferably, identical to the winding group 7. Winding group 19 has a diode 22 connected in parallel thereto whose function and connection is similar to that of diode 14. The secondary 21 has its terminals connected to the spark gaps of two spark plugs 23, 24 which are connected to ground or chassis with their second terminals. The spark plugs 23, 24 have diodes 25, 26 serially connected therewith. The primary 20 of the second winding group 19 is supplied with power from the positive supply bus 5 via an interrupter or breaker switch 27, the other terminal of which is grounded. The two breaker switches 8, 27 are so arranged that their ignition instants with respect to the angular position of the crankshaft CS of the engine differs. The ignition instants, in which the respective breaker switches 8, 27 open to cause an ignition spark, are so selected to the angular position of the crankshaft CS of the ICE that, with respect to the reference R, the angular distance of the ignition instant, from each other, is the same. If two switches are to be controlled, spaced equidistantly about the circumference of the crankshaft CS, as the center, the ignition instants or opening instants of the switches 8, 27 will be 180° spaced from each other. Control of the ignition instants can be done electronically, and the switches 8, 27, although shown as mechanical switches, may be semiconductor switches such as transistors customary in transistorized ignition circuits.

OPERATION

Upon closing of ignition switch 4, the ignition system is ready and operative.

The spark plugs 10, 11, 23, 24 are associated, each, with a cylinder of a four-cylinder ICE. Two spark plugs, associated with two cylinders, are fired simultaneously. Thus, the spark plugs 10, 11 fire at the same time. The spark plugs 23, 24 likewise fire at the same time, but at a different instant of time, for example offset 180° of crankshaft rotation, or 360°, but at the same angular distance from each other with respect to the crankshaft CS. With low material requirements, thus, effective ignition can be obtained since both winding groups 7, 19 have a common, almost closed iron core path formed by the core portions 16, 17.

The high-reluctance portions a, b of magnetically poor conductivity have the effect that the coupling between the winding groups 7, 19 is so loose that, upon interruption of current flow through any one of the primary windings 6, 20, the induced voltage in the other winding groups is, reliably, below the level which can generate a spark at the spark plugs connected to the other winding groups. This reliability of spark suppression or non-occurrence is further enhanced by use of the diodes 12, 13, 25, 26 and/or the free-wheeling diodes 14, 22. The diodes 12, 13, 25, 26 have blocking action with respect to those induction voltages in the associated secondary windings which are caused by current interruption in the primary windings of the other winding group. Therefore, the diodes can be inexpensive diodes since they need block only relatively low voltages.

The diodes 14, 22 are so polarized and matched to the direction of windings of the associate primaries 6, 20 that the diodes 14, 22 permit an inductive compensating current to flow when the primary winding of the other winding group has its current flow interrupted. This, further, reduces excessive rise in the induced voltage in the secondary winding of that one of the winding groups which does not have its primary current interrupted, that is, the winding group which is not triggered to cause a spark will permit current flow through the diode of the other primary winding so that the inductive voltage in the other primary winding will not rise extensively and, hence, the secondary winding on the other primary will not have any substantial voltage therein, thus further reducing the voltage across the respective diodes connected in series with the spark plugs, i.e. diodes 12, 13; 25, 26.

As can be seen from FIG. 1, and in accordance with a feature of the invention, the spacing between primary winding 6 and its associated secondary 9 of winding group 7, as well as the spacing between primary 20 and secondary 21 of winding group 19, is relatively small. The distance between the windings of one winding group from the windings of the other winding group is relatively long—long with respect to the spacing between the windings of any one winding group. This arrangement permits use of various types and shapes of cores, so arranged that the magnetic circuit between the windings is closed, yet has portions of high magnetic reluctance therebetween to decrease coupling.

Embodiment of FIGS. 3 and 4 (collectively): The basic difference between the embodiments of FIGS. 3 and 4 is the encapsulating or potting of the winding groups. The iron core is of generally U-shaped configuration, but it may also be in the shape of a base 30 with a plurality of projecting legs 28, 29 . . . as schematically indicated by the broken lines at the end of the cross elements 30. Gaps c are provided at the ends of the legs 28, 29 and face a cross yoke 31. The yoke 30 is connected to the respective legs 28, 29 . . . Each one of the legs 28, 29 has one of two respective winding groups 32, 33 wound thereon. The winding groups can be similar to the groups 7, 19 of FIGS. 1, 2.

The structure of FIGS. 3 and 4 may be used, for example, with cores for a four-cylinder ICE, with four legs 28, 29, and two more similar legs—not shown. Each one of the four legs, then, will carry a respective winding group. The primary windings of the winding groups can then be controlled by two or four interrupter switches similar to switches 8, 27. If only two such interrupter switches are used, the interrupter switches or breakers can control two winding groups at a time. The secondaries of the respective winding groups are connected, then, to one spark plug of one cylinder, each.

In the embodiment of FIGS. *3a, 3b,* each one of the winding groups 32, 33 is separately potted with a potting compound or encapsulating resin. The elements which are identical in FIGS. 3 and 4 have been given the same reference numerals. In FIG. 4, the winding groups are potted or encapsulated by one common block 34. At least a portion of the core, or possibly all of it, can be covered by encapsulating compound or resin, providing reliable protection of all the components of the ignition coil system against damage or contamination.

Figure 2:
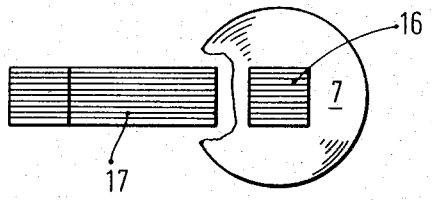
FIG. 2 is a cross section along the broken and offset section line II—II of FIG. 1.

The broken lines 35 in FIGS. 3 and 4 show, schematically, attachment elements, for example, non-magnetic screws, fasteners or clamps, which connect the core portions 28, 30, 29 to the cross yoke 31, with the high reluctances c between the cross yoke 31 and the respective legs 28, 29. The switches 8, 27 may, in all embodiments, be transistor switches. The iron cores are, preferably, laminated, as shown in FIGS. 2, 3*b*, 4*b*.

Various changes and modifications may be made, and any features described herein may be used in any of the embodiments, within the scope of the inventive concept.

We claim:

1. Ignition coil system, for a distributor-less ignition system of a multi-cylinder internal combustion engine having a crankshaft (CS);

a plurality of spark plugs (10, 11, 23, 24), one each being associated with a cylinder of the engine;

a battery (2); and at least two interruptor switches (8,27) controlled for timed opening and closing, in synchronism with rotation of the the crankshaft;

wherein the ignition coil system has at least two winding groups (7, 19, 32, 33), each winding group including a primary winding (6, 20) and a secondary winding (9, 21), the primary winding of each winding group being connected to the battery (2) through an associated interruptor switch (8, 27) and a magnetic circuit (16, 17, a, b; 28, 29, 30, 31, c) coupling the primary and secondary windings of any one group, said magnetic circuit comprising iron core portions (16, 17, 28, 29), and interruption portions (a, b, c) of magnetic flux conductivity which is poor with respect to the flux conductivity of the iron core portion, the winding groups being so located and wound on the magnetic core portions that, upon interruption of current flow from the battery by the respective interruptor switch through any one primary winding, only that one of the secondary windings which is associated with said one primary winding will have a high voltage induced therein to cause sparkover of the at least one spark plug connected to the associated secondary coil, and wherein, in accordance with the invention, each one of the winding groups (7, 19; 32, 33) has its respective primary winding (6, 20) and the respective secondary winding (9, 21) wound on an individual core portion (16, 17; 28, 29) common to the respective primary and secondary windings, said core portions associated with any one winding group being coupled to core portions of another winding group by said interruption portion (a, b, c), and the distance between the primary and secondary winding on any one core portion is small with respect to the distance between the winding groups, and wherein the core portions, on which the winding groups are wound, form essentially straight core elements (28, 29);

the core elements are connected by an iron yoke (30) at one end; and a cross yoke (31) is provided, spaced from the other end of the core elements by the said interruption portions (c).

2. Ignition coil system, for a distributor-less ignition system of a multi-cylinder internal combustion engine having a crankshaft (CS);

a plurality of spark plugs (10, 11, 23, 24), one each being associated with a cylinder of the engine;

a battery (2); and at least two interruptor switches (8, 27) controlled for timed opening and closing, in synchronism with rotation of the the crankshaft, wherein the ignition coil system has at least two winding groups (7, 19, 32, 33), each winding group including a primary winding (6, 20) and a secondary winding (9, 21), the primary winding of each winding group being connected to the battery (2) through an associated interruptor switch (8, 27) and a magnetic circuit (16, 17, a, b; 28, 29, 30, 31, c) coupling the primary and secondary windings of any one group, and wherein (A) the respective primary and secondary windings (6,20) and secondary windings (9, 21) of any one winding group (1) overlap, (2) are wound coaxially on a respective individual core portion (16, 17; 28, 29), (3) are spaced from each other a distance which is small with respect to the distance between different winding groups on respective core portions, and (4) have a magnetic coupling which is substantially tighter and physically closer than the magnetic coupling between the core portions on which different ones of said winding groups, including the primary and secondary windings thereof, are located; and (B) said individual core portions each form a closed loop core, with interruption portions of magnetically high reluctance between the respective core portions on which the respective winding groups are located.

3. Ignition coil system according to claim 2, wherein (FIGS. 1, 2, 3) each winding group is potted or encapsulated by a potting of encapsulating compound or resin.

4. Ignition coil system according to claim 2, wherein (FIGS. 4*a*, 4*b*) all winding groups are potted in, or encapsulated by, a common potting compound or encapsulating resin.

5. Ignition coil system according to claim 2, wherein said core portions (16, 17) have a generally L shape.

6. Ignition coil system according to claim 2, further comprising a diode (14, 27), each, connected in parallel to the primary windings of the respective winding groups, the diode being poled for blocking of current flow therethrough from the battery (2) by passage of current which is induced in any one of the primary windings upon interruption of current in another one of the primary windings.

7. Ignition coil system according to claim 2, further comprising at least one diode (12, 13; 25, 26) connected between the secondary windings (9, 21) and the respective spark plugs, and poled to pass current flow upon interruption of current in the primary winding of the winding group to which the spark plugs are connected, but blocking inductive voltage due to interruption of current flow through the primary winding of another one of the winding groups.

8. Ignition coil system according to claim 1, wherein the core elements (28, 29) and the connecting yoke (30) form integral iron elements in the shape of a U or multiples of U, connected together by the connecting yoke (30), common to the core elements forming the legs of the U.

9. Ignition coil system according to claim 2, wherein (FIG. 1) the magnetic circuit comprises two iron core portions (16, 17);

the interruption portions (a, b) of high magnetic reluctance being located between the two core portions;

wherein each core portion (16, 17) has a respective winding group (7, 19) wound thereon;

wherein the primary windings (, 20) of the two winding groups each are serially connected with a respective interruptor or breaker switch (8, 27) to the battery;

and wherein the ignition instants of the operation of the interruptor or breaker switches, at which time the switches open the circuit, with respect to the crankshaft (CS) of the engine, have the same angular distance.

10. Ignition coil system according to claim 2, wherein the magnetically high-reluctance interruption portions are formed by zones having magnetic properties similar to air gaps.

* * * * *